US005739795A

United States Patent [19]

Chanteau et al.

[11] Patent Number: 5,739,795

[45] Date of Patent: Apr. 14, 1998

[54] PORTABLE RECEIVER WITH ANTENNA

[75] Inventors: Pierre Chanteau, La Haye Malherbe, France; Bram P. Van Sambeek; Steven T. Slot, both of Eindhoven, Netherlands; Daniele Santilli, Waalre, Netherlands

[73] Assignee: U.S. Philips Corporation, N.Y., N.Y.

[21] Appl. No.: 626,091

[22] Filed: Apr. 3, 1996

[30] Foreign Application Priority Data

Apr. 5, 1995 [FR] France ..... 95 04041

[51] Int. Cl.[6] ..... H01Q 1/24

[52] U.S. Cl. ..... 343/795; 343/702

[58] Field of Search ..... 343/795, 702, 343/700 MS, 793, 802, 803, 807; H01Q 1/24, 9/28

[56] References Cited

U.S. PATENT DOCUMENTS 3,020,550 2/1962 Beever ..... 343/795

4,721,962 1/1988 Gorzel ..... 343/795

5,365,246 11/1994 Rasinger et al. ..... 343/702

FOREIGN PATENT DOCUMENTS 56-144645 11/1981 Japan .

59-186401 10/1984 Japan ..... 343/866

*Primary Examiner*—Hoanganh T. Le

*Attorney, Agent, or Firm*—Robert J. Kraus

[57] ABSTRACT

The receiver which comprises a flat picture screen (20) has an antenna which comprises two articulated main plates (4, 5) symmetrically disposed on either one of the two sides of the screen, and forming an angle with each other, as well as two plates (2, 3) parallel with the screen and symmetrical to each other relative to the median vertical plane (19) of the screen.

9 Claims, 1 Drawing Sheet

PORTABLE RECEIVER WITH ANTENNA

BACKGROUND OF THE INVENTION

The present invention relates to a portable receiver with an antenna for receiving electromagnetic waves, comprising a box which accommodates an electronic circuit.

Such a receiver is, for example, a radio receiver or a flat-panel television receiver, or a flat-panel teletext receiver, for example, with a liquid crystal display.

A particular antenna is known from the document JP-A-56 144 645. Generally, the receiving diagram of a symmetrical antenna, for example, an antenna called YAGI, is itself symmetrical with two lobes separated by two recesses, that is to say, two receiving directions for waves for which the antenna gain is zero. The arrangement described by this document utilizes two antennas of the type called "butterfly", made each of a pair of flat and triangular sides and placed flat along two opposite insulating surfaces of a box whose four other surfaces are metallic, in order to obtain an invariably stable reception in every direction and to make use of the presence of the metallic surfaces for the formation of a reflective element for the antenna.

SUMMARY OF INVENTION

It is an object of the invention to obtain a perfectly omnidirectional reception diagram with a high gain.

For this purpose, a receiver according to the invention is characterized in that the antenna comprises for an application in the UHF frequency range:

- two electrically conductive plates, called main plates, each attached along a line on the exterior and on either one of the two sides of the box, practically symmetrically,
- and two plates, called parallel plates, which are practically triangular with their points turned to each other and which are contained in the same symmetric plane with respect to each other, and which are connected by one of their edges to the edge turned towards the box of each of the main plates, and a slewability is provided in the connection line of each main plate and, in the position of use, the main plates and the parallel plates form an angle between them.

The invention is thus based on the idea of subdividing each of the sides of a "butterfly" antenna into two parts which are slewable to each other, and placing the box between the two parts that are remotest from each other, which parts then appear as elements of the box.

In this manner the omnidirectional character is improved and, furthermore, this disposition makes it possible to fold the plates in front of or behind the box to reduce the dimensions of the receiver when it is not used.

Preferably, the distance measured along the plates of the antenna between the remotest ends of the two plates is of the order of a wavelength $\lambda$ of a receiving frequency.

With an antenna situated inside a box, a length equal to $\lambda$ will lead to too cumbersome a box, whereas such a length becomes possible with the arrangement according to the invention, and the results are thus better because a "butterfly" antenna receives a frequency band that is wider when it is full-wave than when it is half-wave.

Advantageously, the parallel plates which are practically triangular have each a pattern that is dissymmetrical relative to a horizontal axis.

This allows of obtaining a better functioning when the box is inclined.

In a particular embodiment, a parallel plate is connected to a main plate via a transition plate which forms an angle both to the main plate and to the connecting plate.

This makes it possible to "fill in" the recesses of the directional diagram even better.

The main plates and the box advantageously have practically the same maximum dimension in a direction parallel with the connecting line of a plate.

In an embodiment the plates are made of plastic material and are covered by a soft metallized foil.

Such a soft metallized foil can ensure a continuity at the slewings by folding along with the slewing, or may even form a hinge by itself.

A portable receiver according to the invention is advantageously a picture. receiver with a picture screen.

In a particular embodiment the picture screen is placed between the points of the practically triangular parallel plates.

These and other aspects of the invention will be apparent from and elucidated with reference to the embodiments described hereinafter.

DETAILED DESCRIPTION OF THE PREFERRED EMBODIMENTS

Figure 1:
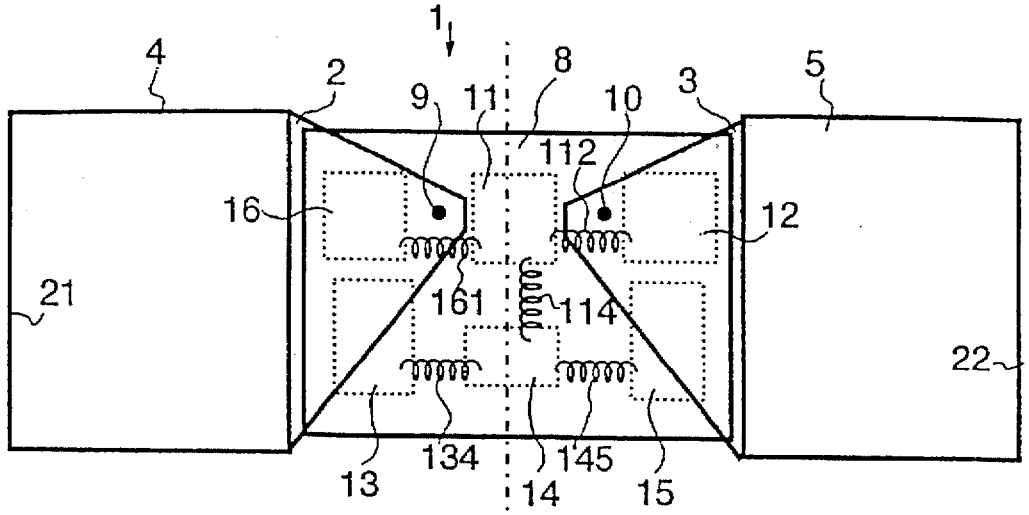
FIGS. 1 and 2 diagrammatically represent a receiver according to the invention in front and top view, respectively.

The portable picture receiver 1 shown in the Figures comprises a box 8 in which an electronic circuit 11–16 is placed. This box 8 which could as well have any other form, is here practically flat and rectangular. It is practically symmetrical relative to a plane of symmetry 19 which is perpendicular to its large surfaces and perpendicular to the plane of the drawing sheet.

Box 8 has a picture screen 20 (FIG. 2), for example, a liquid crystal display, which occupies a part of its large flat surface which is turned downwards in the Figure.

The receiver is intended for the reception of waves in the UHF frequency range and notably for the reception of teletext transmissions.

It has an antenna which comprises two plates 4 and 5 which are electrically conductive. These two plates are disposed on either one of the two sides of box 8 and attached practically symmetrically relative to this box 8 and relative to the plane of symmetry 19. The plates 4 and 5 together form an angle here whose vertex S lies behind the screen, for a viewer positioned in front of the screen, this place being visible in FIG. 2, where the planes of plates 4, 5 are perpendicular to the drawing sheet.

The distance between the remotest ends 21 and 22 of the plates 4 and 5 is of the order of a wavelength $\lambda$ of the centre frequency of the receiving frequency range, measured following the surface of the plates between the points 21 and 22.

The antenna further comprises two plates 2, 3 called parallel plates which are placed in parallel with the flat box 8 and are electrically and mechanically connected to the first plate 4 and to the second plate 5, respectively.

Figure 2:
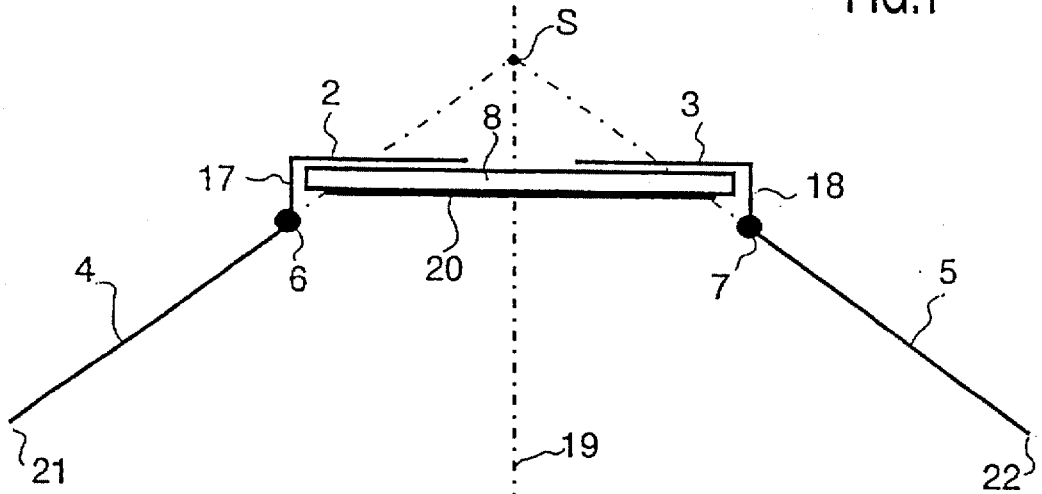

It is also possible to imagine an arrangement of the same elements in which the box 8 would be turned back relative to the position it occupies in FIG. 2, that is, the screen would be turned towards the top of the Figure, while the box is placed on top of plates 2 and 3, the vertex S then lying before the screen.

The liquid crystal display 20 is situated in the proximity of plates 2, 3, but it does not play a role of a ground plane, because it is not a good conductor for the frequencies used. At best it plays approximately a role of directing element in the sense of this word in the YAGI antennas. Similarly, in order not to disturb the operation of the antenna, the electronic circuit in box 8 is divided into various sub-sets 11, 12, 13, 14, 15, 16 of which the ground planes are electrically interconnected via the inductances 161, 112, 114, 134, 145.

The parallel plates 2 and 3 have a nearly triangular design (FIG. 1). The triangles are dissymmetrical, in other words, they are not isosceles. For example, the point to the right of plate 2 and the point to the right of plate 3 in FIG. 1 are higher than the middle of the plates and the box. This dissymmetry is not always necessary. In lieu of triangular plates, there could be used semi-circular or semi-elliptical plates, without this changing very much, which plates have forms that can be compared with triangular "blunted" triangular forms.

An electric link to the electronic circuit may be connected to the antenna at a point 9 near to the point of the parallel plate 2 that is turned towards the other parallel plate 3, and at a point 10 near to the point of the parallel plate 3 that is turned to the other parallel plate 2. In practice, an impedance correction symmetrizer of a known type (not shown) is connected between the points 9 and 10 of the antenna, and the electric link to the electronic circuit may therefore be connected to either point 9 or 10. The TV tuner connected to either point is, for example, element 11.

The antenna may further comprise (FIG. 2) a transition plate 17 arranged between the plates 4 and 2 and which connects the plates 4 and 2 electrically and mechanically. Another electroconductive transition plate 18 is arranged in the same fashion between the plates 3 and 5 which it connects mechanically and electrically. These plates 17 and 18 form a 90° angle to the plates 2 and 3 and, in the position in which they are represented, but which may be adjusted, as will be explained hereinafter, they form an angle of about 45° to the plates 4, 5.

The main plates 4 and 5 as well as the transition plates 17, 18 are, for example, rectangular and they have a height which is nearly equal to that of the box. One could also imagine, for example, trapezoidal, or also semi-circular main plates (connected to the transition plates along a vertical diameter) with, however, characteristics that are slightly degraded in the latter case.

The two plates 4 and 17 (or the two plates 5 and 18) may be rigidly attached to one another. However, it is preferable to provide electrically conductive slewing capacities 6 and 7 respectively, between the two adjacent plates 4 and 17 and between the two adjacent plates 5 and 18. This makes it possible to adjust the angle between the plates 4 and 17 or 5 and 18 and also to fold the plates back for the transport of the receiver.

Figure 3:
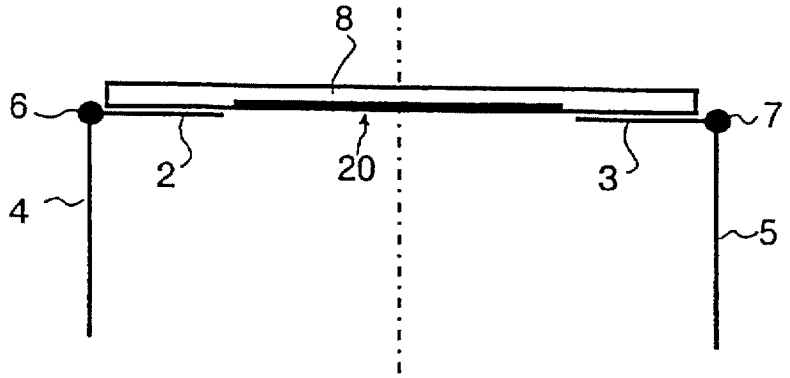
FIG. 3 represents a variant in top view.

In another embodiment which is illustrated by FIG. 3, the triangular parts of the antennas 2 and 3 are placed in front of the box on either side of the screen 20. Furthermore, the transition parts 17 and 18 are absent. The screen 8 could be turned upwards there as well. Electrically conductive slewing capacities 6 and 7 are provided between the two adjacent plates 4 and 2 and two adjacent plates 5 and 3, respectively.

The plates 17, 2 (or 18, 3) may be made of a single sheet, for example, a folded aluminium sheet. In the case where slewing 6 (or 7) is not foreseen, this is even the set of plates 4, 17, 2 (or 5, 18, 3) that can be made of a single-folded sheet. The metallic plates can be covered by plastic or paints to improve their aspect.

In a variant, the plates and the slewings can be realized in a plastic material, the plates being coated by a soft metallized foil, for example, stuck onto the plates of plastic material.

What is claimed is:

1. Portable receiver with an antenna for receiving electromagnetic waves, comprising a box which accommodates an electronic circuit, characterized in that the antenna comprises for an application in the UHF frequency range:

two electrically conductive main plates, each attached along a line on the exterior and on either one of the two sides of the box, practically symmetrically, and two parallel plates, which are practically triangular with their points turned to each other and which are contained in the same symmetric plane with respect to each other, and which are connected by one of their edges to the edge turned towards the box of each of the main plates, and a slewability is provided in the connection line of each main plate and, in the position of use, the main plates and the parallel plates form an angle between them.

2. Portable receiver as claimed in claim 1, characterized in that the distance measured along the main plates and the parallel plates of the antenna between the ends that are remotest from each other of the two main plates is of the order of a wavelength of a receiving frequency.

3. Portable receiver as claimed claim 1, characterized in that the parallel plates which are practically triangular have each a pattern that is dissymmetrical relative to a horizontal axis.

4. Portable receiver as claimed in claim 1, characterized in that the main plates and the box advantageously have practically the same maximum dimension in a direction parallel with the connecting line of a plate.

5. Portable receiver as claimed in claim 1, characterized in that a parallel plate is connected to a main plate via a transition plate which forms an angle both to the main plate and to the parallel plate.

6. Portable receiver as claimed in claim 1, characterized in that the main plates and the parallel plates are made of plastic material and are coated by a soft metallized foil.

7. Portable receiver as claimed in claim 1, characterized in that it is a picture receiver with a picture screen.

8. Portable receiver as claimed in claim 7, characterized in that the practically triangular parallel plates are placed behind the receiver.

9. Portable receiver as claimed in claim 7, characterized in that the practically triangular parallel plates leave between their points a space that is sufficient for placing the picture screen there.

* * * * *